US007220223B2

(12) United States Patent
Erdt et al.

(10) Patent No.: US 7,220,223 B2
(45) Date of Patent: May 22, 2007

(54) PRINTING PRESS HAVING AN APPARATUS FOR MEASURING A PRINTED PRODUCT

(75) Inventors: Johann Erdt, Augsburg (DE); Theo Keilhau, Neusäb (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 93 days.

(21) Appl. No.: 11/082,116

(22) Filed: Mar. 16, 2005

(65) Prior Publication Data

US 2005/0209078 A1 Sep. 22, 2005

(30) Foreign Application Priority Data

Mar. 17, 2004 (DE) ..... 10 2004 012 930

(51) Int. Cl.
*B31B 1/56* (2006.01)
*B31F 1/10* (2006.01)

(52) U.S. Cl. ..... 493/25; 493/445

(58) Field of Classification Search ..... 493/442, 493/443, 444, 445, 8, 23, 25, 30, 34; 101/212, 101/232, 247; 270/20.1, 49, 50
See application file for complete search history.

(56) References Cited

U.S. PATENT DOCUMENTS 5,080,339 A * 1/1992 Hirahara ..... 493/444
5,147,276 A * 9/1992 Stab ..... 493/444
5,242,364 A * 9/1993 Lehmann ..... 493/8
5,937,757 A * 8/1999 Jackson et al. ..... 270/20.1
5,964,154 A * 10/1999 Michalik ..... 493/444
6,042,529 A * 3/2000 Hubler et al. ..... 493/445
6,475,129 B1 * 11/2002 Lehmann ..... 493/25
6,743,161 B2 * 6/2004 Dannemann et al. ..... 493/34

FOREIGN PATENT DOCUMENTS

DE 100 52 476 A1 5/2002
EP 0 511 488 A1 11/1992
EP 1004531 A2 * 5/2000
EP 1 321 411 A1 6/2003
JP 07237812 A 9/1995

* cited by examiner

*Primary Examiner*—Louis Huynh
(74) *Attorney, Agent, or Firm*—Leydig, Voit & Mayer, Ltd

(57) ABSTRACT

A printing press having an apparatus for determining the product thickness of a folded product which is fed to folding rolls for making a fold known as the third fold. The apparatus has measuring heads that are arranged on both sides of a folding roll bearing levers. For the purpose of presetting, the product to be folded is introduced slowly between folding rolls. The position of the folding rolls is determined, and a setting signal is generated therefrom and supplied to an actuating motor via a machine presetting means. The actuating motor sets the position of the folding roll levers, such that the folding rolls can be set relative to one another with regard to their mutual spacing, in accordance with the thickness of the folded product.

2 Claims, 1 Drawing Sheet

PRINTING PRESS HAVING AN APPARATUS FOR MEASURING A PRINTED PRODUCT

FIELD OF THE INVENTION

The invention relates to a printing press having an apparatus for folding printed products, and more particularly to an apparatus for folding printed products that has means for presetting folding rolls according to the thickness of the printed products.

BACKGROUND OF THE INVENTION

In printing presses such as web-fed offset rotary presses, the printed products often have to be folded. To that end, the printed webs are guided through a folding former and provided with a first fold, which is known as the longitudinal fold. Subsequently, the web is cut in the folder and provided with a further fold known as the first transverse fold. Webs are frequently laid on top of one another and web streams are guided via the folding former. If said streams are cut and fed to the transverse folding apparatus, it is possible to gather the cut printed products. At this point, depending on the desired end product, great differences may occur in the thickness of the printed products which are optionally to be provided with a second longitudinal fold.

While the first longitudinal fold and the first transverse fold do not require the web sections or web to be folded to be stopped, to produce the second transverse fold the product is to be guided through between two folding rolls and has to be stopped beforehand. A folding blade then pushes the folded product between the rotating folding rolls.

The folding rolls have to be at a well-defined distance in accordance with the thickness of the product to be folded. This requires the folding rolls to be adjusted to the thickness of the product that is to be folded. To that end, it is necessary to know the thickness of the product to be folded in order to adjust the folding rolls accordingly.

Conventionally, the product thickness or layer thickness has been measured manually, for example, using micrometers or similar instruments. The folding rolls for the third fold are then adjusted manually or by means of manual positioning commands from actuating drives in the machine that makes the third fold.

BRIEF SUMMARY OF THE INVENTION

In view of the foregoing, it is an object of the invention to measure automatically the thickness of the products which are to be folded, in particular the products which are to be provided with a second longitudinal fold, and to make it possible to convert the measured results automatically via the machine controller into actuating commands for positioning the folding rolls, in particular in the third fold, in order to preset the machine.

This object is achieved by the invention. In accordance with the invention, the position of an element which touches the product which is to be processed is measured by a measuring apparatus, and actuating signals for the machine presetting means are derived as a function of the position of said element. A machine presetting means then fixes the position of the folding rolls as a function of the measured thickness of the product.

The invention will be described in detail below using exemplary embodiments illustrated in the drawings, of which:

DETAILED DESCRIPTION OF THE INVENTION

Figure 1A:
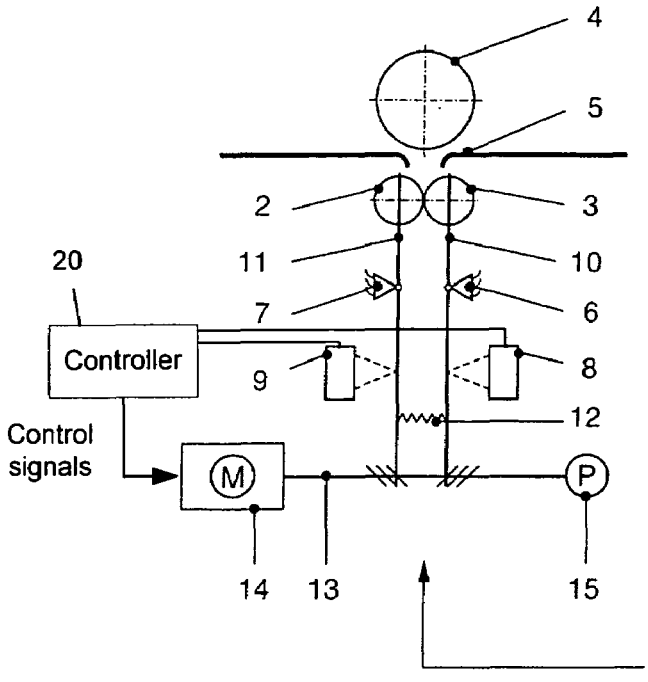
FIGS. 1A and 1B are schematic views showing a measuring apparatus on folding rolls.

FIG. 1 shows schematically an exemplary embodiment of a device for producing a second longitudinal fold, also sometimes known as a third fold, in printed products of a printing press. For this purpose, the folded products 1 have to be stopped, for which purpose appropriate stops and brake elements in the form of belts or brake shoes are used. As mentioned earlier in the Background, the products 1 may have a variable number of individual printed sheets, which are to be folded or have been folded, in accordance with the desired end product.

Therefore, the separation between folding rolls 2 and 3 has to be set to the respective thickness of the folded product 1. For this reason, it is necessary to know the thickness of the respective product which is to be folded.

After they have been stopped, the folded products 1 are pushed between the folding rolls 2 and 3 with the aid of a folding drum 4. Prior to this, the folded products 1 are fed over a folding table or a sliding plate 5, with the result that they come to lie in the desired position above the folding rolls 2, 3 after positionally correct stopping, and the second longitudinal fold can be produced in a positionally correct manner with the aid of the folding drum 4.

The folding rolls 2, 3 can be pivoted by means of folding roll bearing levers 10, 11, the folding roll bearing lever 10 bearing the folding roll 3, and the bearing lever 11 bearing the folding roll 2. The bearing levers 10, 11 are supported on bearings 6, 7 and are pulled together by a spring 12, with the result that the folding rolls 2, 3 are pressed against one another if there is no folded product 1 between them.

The position of the folding roll bearing levers 10, 11 is changed by an actuating drive 13, for which purpose a motor 14 and a suitable feedback means 15 are required. The folding roll bearing levers 10, 11 are adjusted by appropriate control of said parts, in such a way that the required distance between the folding rolls 2, 3 is set in accordance with the thickness of the respective folded product 1 on the sliding plate 5. For this purpose, the machine presetting means becomes active in a known manner, said machine presetting means generating, as a function of the thickness of the folded product 1 measured according to the invention, signals which are fed to the motor 14, with the result that the actuating drive 13 pivots the folding roll bearing levers 10, 11 appropriately. The actuating drive 13 can preferably comprise a threaded spindle which has threads with an opposing pitch.

Measuring heads 8, 9 are arranged on both sides of the folding roll bearing levers 10, 11. The measuring heads 8, 9 detect the positions of the levers 10, 11 which are used according to the invention to determine the thickness of the folded product 1 on the sliding plate 5.

Figure 1B:
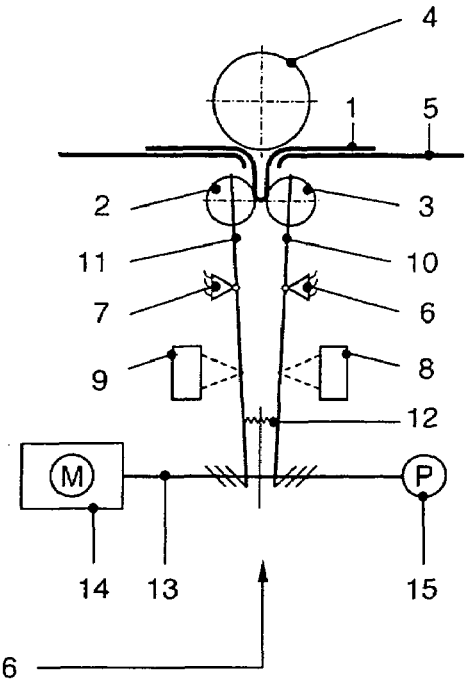

In a novel way, the folding rolls 2, 3 move into the zero position during the alignment of the folding unit, that is to say they touch. This is possible if there is no folded product 1 between the folding rolls 2, 3, as can be seen in FIG. 1A. FIG. 1B shows how a folded product 1 is situated between the folding rolls 2 and 3, with the result that the latter are moved apart from one another, counter to the pressure of the spring 12. The folding blade of the folding drum 4 between the folding rolls 2, 3 brings about this pressing apart of the folding rolls 2, 3 when the folded product 1 is fed into the nip between the two folding rolls. As a result, the relative position of the folding roll bearing levers 10, 11 is changed. The position of the folding roll bearing levers 10, 11 thus changes proportionally with respect to the thickness of the folded product 1 when the latter is pushed in between the folding rolls 2, 3. This position of the folding roll bearing levers 10, 11 is detected by the measuring heads 8, 9. The readings of the measuring heads 8, 9 are sent to a controller 20, which processes the readings to determine the separation between the folding rolls 2, 3. This separation corresponds to the thickness of the folded printed product. The controller 20 then generates control signals for actuating the motor 14 based on the measured thickness of the printed product. In response to the actuation signals, the motor 14 moves the actuating drive 13 in such a way that the folding rolls 2, 3 can be preset to the respective thickness of the folded products 1.

In a prior application by the same applicants which was filed on Jan. 27, 2004 at the German Patent Office with the designation PB 04645 and whose contents are incorporated into the present application, a circuit is known for easier setting of a system of a product web processing machine, which system is dependent on the thickness of a product web. Here, a transmitter of a measuring head and a receiver are arranged on each side of the product web, with the result that reflected beams are measured as a function of the thickness of the product web and measured values can thus be generated as a function of the thickness of the web. It is possible to use said measured values in a computer to form measured signals in accordance with the web thickness. This circuit, which is described in detail in said prior application, can be used advantageously to activate the motor 14 and a suitable feedback means 15, the measuring heads 8, 9 not being arranged on both sides of the product web or folded products but in each case on a folding roll bearing lever 10, 11 in the present invention, in a deviation from the prior application.

Figure 2A:
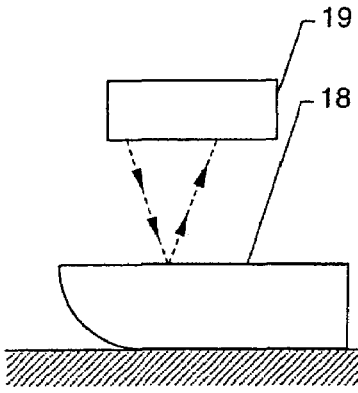
FIGS. 2A and 2B are schematic views showing a measuring apparatus on a brake shoe.
Figure 2B:
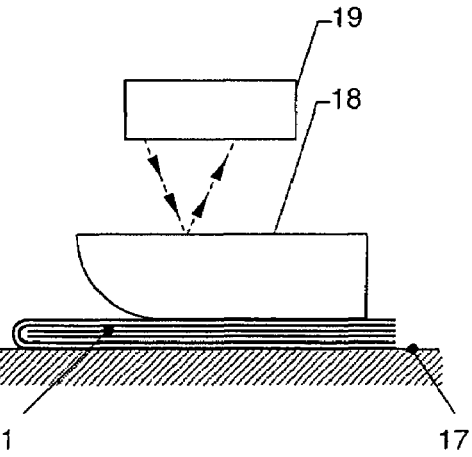

FIGS. 2A and 2B illustrate a second exemplary embodiment in which, in a manner according to the invention, the determination of the thickness of the folded product 1 for the purpose of setting the folding rolls 2, 3 shown in FIG. 1 is carried out with the aid of a brake shoe 18 for braking the folded products 1, which are fed in on the surface of a sliding table 17.

In a manner analogous to the arrangement of the measuring heads 8, 9 shown in FIG. 1, a measuring head 19 is arranged at a distance above the brake shoe 18 in the exemplary embodiment according to FIGS. 2A and 2B. According to the invention, a differential measurement is carried out, likewise in a manner analogous to the differential measurement according to FIG. 1.

The differential measurement of the position of a brake shoe 18 or of a similar element takes place with and without a printed product which is to be folded between said component and the sliding table 17. The result of this is the determination of the product thickness and generation of an actuating signal for presetting the folding rolls. The thickness of the printed products 1 is determined from the differential measurement of the position with respect to the sliding table 17.

By way of example, in FIG. 2A, the brake shoe 18 is initially against the surface of the sliding table 17, without there being a folded product 1 between the brake shoe 18 and the sliding table 17. In this state without a printed product 1, the position of the brake shoe 18 is determined. In FIG. 2B, the folded product 1 is moved to a position underneath the brake shoe 18. The position of the brake shoe 18 in this state is also measured, and the difference between the two measured brake shoe positions is determined. It can be seen that this position difference measured by the measuring head 19 corresponds to the thickness of the folded product 1.

An actuating signal for a motor is generated from the measured thickness, for example, in an analogous manner to the illustration according to FIG. 1. Using the actuating signal, the distance of the folding rolls can be set with respect to one another in accordance with the thickness of the folded product 1. For this purpose, it is also once again advantageously possible to use the circuit according to the above mentioned prior application. However, other circuits can also be used readily for the exemplary embodiments according to FIGS. 1 and 2, within the scope of the capabilities of the person skilled in the art, to carry out the setting operations on the folding rolls based on the determined thicknesses of the folded products.

The application of the principle according to the invention for determining the thickness of the folded products is not limited to the exemplary embodiments shown in FIGS. 1 and 2. Rather, further possibilities using the principle on which the invention is based are available to the person skilled in the art, using which principle said person skilled in the art can perform the folding roll presetting operations in a manner which is dependent on the product thickness.

What is claimed is:

1. A folding apparatus in a printing press for folding a printed product, comprising:

first and second folding rolls oppositely disposed for folding the printed product, the folding rolls being mounted on respective bearing levers and coming in contact with the printed product;

a folding drum for introducing the printed product into a position between the folding rolls;

a spring for pulling together the bearing levers of the folding rolls, the folding rolls being in contact before the printed product is introduced therebetween and being separated when the printed product is introduced therebetween;

a controller generating control signals for pre-setting the positions of the first and second rolls; and first and second measuring heads disposed to measure respective positions of the bearing levers of the first and second folding rolls, wherein the measuring heads measure relative positions of the bearing levers with and without the printed product between the first and second rolls, and wherein the controller generates the control signals for presetting positions of the first and second rolls based on a difference between the measured relative positions.

2. A folding apparatus as in claim 1, further comprising a motor coupled to the bearing levers for pivoting the bearing levers to adjust a distance between the first and second folding rolls, said motor being actuated by the control signals generated by the controller.

* * * * *